US007814600B2

(12) United States Patent
Bournand

(10) Patent No.: US 7,814,600 B2
(45) Date of Patent: Oct. 19, 2010

(54) CORROSION PROTECTION SYSTEM FOR A CONSTRUCTION INCLUDING A STAY CABLE

(75) Inventor: Yves Bournand, Montigny le Bretonneux (FR)

(73) Assignee: VSL International AG (CH)

( * ) Notice: Subject to any disclaimer, the term of this patent is extended or adjusted under 35 U.S.C. 154(b) by 638 days.

(21) Appl. No.: 11/719,126

(22) PCT Filed: Nov. 12, 2004

(86) PCT No.: PCT/EP2004/052952

§ 371 (c)(1),
(2), (4) Date: May 11, 2007

(87) PCT Pub. No.: WO2006/050756

PCT Pub. Date: May 18, 2006

(65) Prior Publication Data

US 2007/0294913 A1 Dec. 27, 2007

(51) Int. Cl.
*E01D 19/16* (2006.01)

(52) U.S. Cl. ..... 14/22

(58) Field of Classification Search ..... 14/18, 14/19, 22

See application file for complete search history.

(56) References Cited

U.S. PATENT DOCUMENTS 4,856,254 A * 8/1989 Jungwirth ..... 52/741.1
7,200,886 B2 * 4/2007 Nuetzel et al. ..... 14/22

FOREIGN PATENT DOCUMENTS

| | | | |
|---|---|---|---|
| DE | 19710170 A1 | | 9/1988 |
| DE | 3723795 A1 | | 12/1988 |
| RU | 2178046 C1 | | 1/2002 |
| WO | WO 88/09847 | * | 12/1988 |
| WO | 2004057112 A1 | | 7/2004 |

* cited by examiner

*Primary Examiner*—Gary S Hartmann
(74) *Attorney, Agent, or Firm*—Hahn Loeser & Parks, LLP; John J. Cunniff

(57) ABSTRACT

The invention relates to a corrosion protection system for a stay cable construction including a multiplicity of tension members made of parallel steel tensile elements, extending between a first anchorage and a second anchorage, and comprising two opposite ends, the first end co-operating with the first anchorage and the said second end co-operating with the second anchorage. The corrosion protection system involves the use of tensile elements which are not provided with a permanent corrosion protection during their fabrication. This corrosion protection system includes: a plurality of stay pipes, each freely surrounding a tension member made of unprotected tensile elements, a dehumidification device which produces dry air, supply pipes supplying the dry air to predetermined points situated on the first anchorage, the second anchorage, and the stay pipes, a ventilation device pushes the dry air in the supply pipes, surveying, measuring, controlling and testing facilities.

20 Claims, 3 Drawing Sheets

CORROSION PROTECTION SYSTEM FOR A CONSTRUCTION INCLUDING A STAY CABLE

BACKGROUND OF THE INVENTION

The invention relates to corrosion protection for a construction including a stay cable.

Designated by stay cable is particularly, but not exclusively, a cable used for the construction of suspended and stayed structures, such as suspension bridges, cable-stayed bridges, stadium roofs, buildings, telecommunication towers, etc.

The invention also relates to a stay cable construction, for example a stay cable bridge, which includes the aforementioned corrosion protection system.

A stay cable bridge generally includes:

a deck, which includes a structural member, for example a metallic structural member, with, also for example, at least one internal chamber, at least one pylon, said pylon including at least one substantially upright element, each pylon including namely a first part, which extends under the deck, and a second part, which extends above the deck, a multiplicity of tension members, each tension member being made up of parallel steel tensile elements, extending between a deck anchorage situated on the deck and a pylon anchorage situated on the second part of the pylon.

A long stay cable bridge can comprise hundreds of tension members, and the presence of this great number of tension members leads to a significant problem in that the exposure to wind creates wind forces that are transferred to the rest of the structure. In particular, mechanical resistance of the deck and the pylon must be improved, and the cost of the construction is consequently higher.

SUMMARY OF THE INVENTION

Owing to the fact that the amount of wind forces depends on the diameter of the tension members, one of the aims of the invention is to reduce the diameter of the tension members.

The steel tensile elements used in the field of construction of stay cables bridges are generally corrosion-protected (for years) by a layer of grease and a sheath, which surrounds the layer of grease. The presence of the layer of grease and of the sheath increases the diameter of the strand.

The increase in diameter of each of the tensile elements constituting a tension member substantially increases the diameter of this tension member.

One result which the invention aims to obtain is a corrosion protection system, which overcomes in particular this drawback.

Another result which the invention aims to obtain is a continuous monitoring of the corrosion protection system.

To this end, proposed is, on the one hand, to use tensile elements which are not provided with a permanent corrosion protection during their fabrication (for example, which are not greased and sheathed in a conventional way), these tensile elements being referred to as unprotected tensile elements, and, on the other hand, to use a corrosion protection system which includes:

a plurality of stay pipes, each stay pipe freely surrounding a tension member made up of unprotected tensile elements, a dehumidification device which produces air with a predetermined average humidity rate, this air being referred to as dry air, a plurality of pipes, referred to as dry air supply pipes, intended to supply the dry air from the dehumidification device to predetermined points, each of these points being situated on one of the three devices that are the first anchorage, the second anchorage, the plurality of stay pipes, a ventilation device which pushes the dry air in the pipes of the plurality of dry air supply pipes, surveying, measuring, controlling and testing facilities.

BRIEF DESCRIPTION OF THE SEVERAL VIEWS OF THE DRAWINGS

The invention will be better understood from reading the following description, given by way of non-limiting example, with reference to the attached drawing representing schematically.

DETAILED DESCRIPTION OF THE INVENTION

Figure 1:
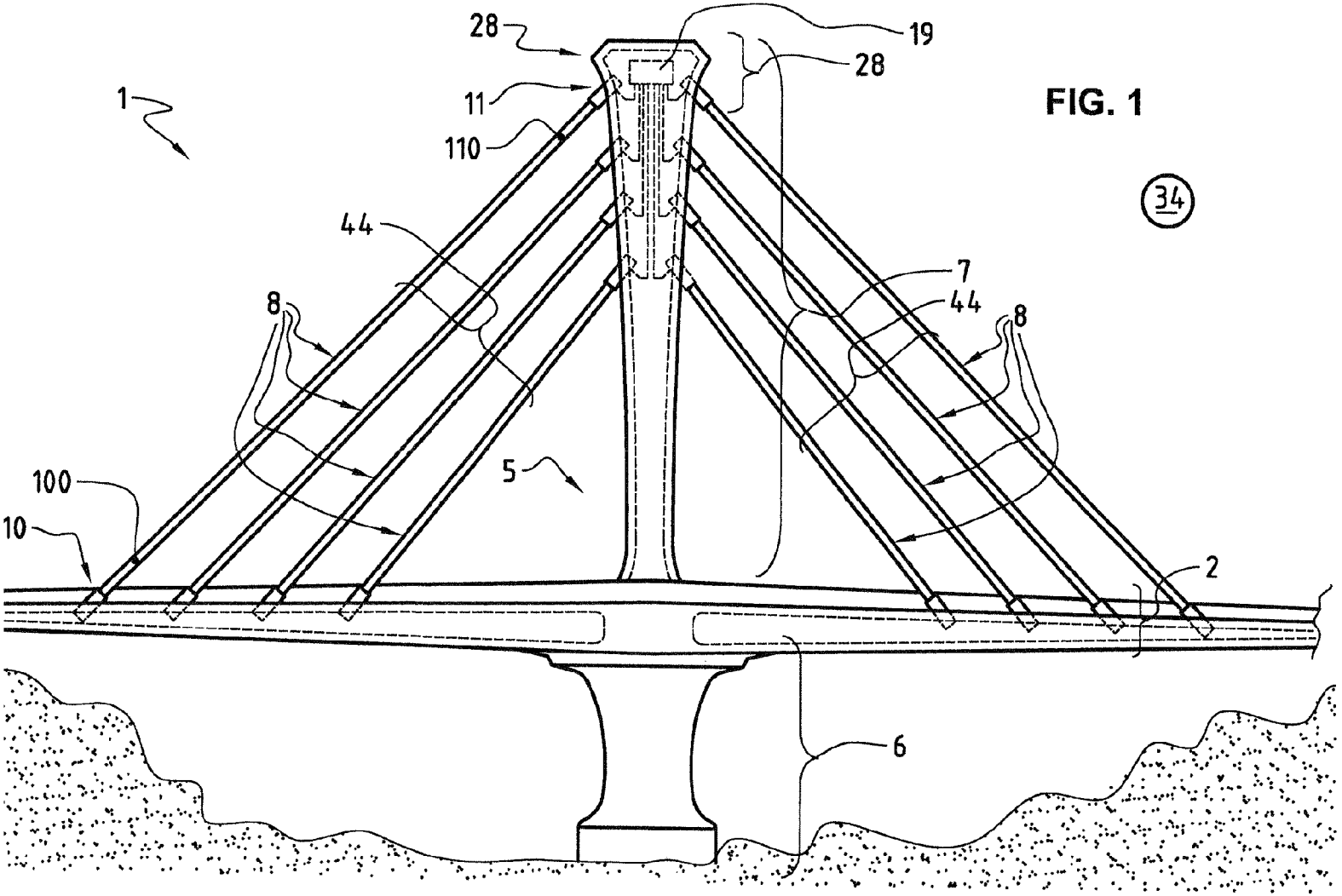
FIG. 1: a lateral view of a stay cable bridge.
Figure 2:
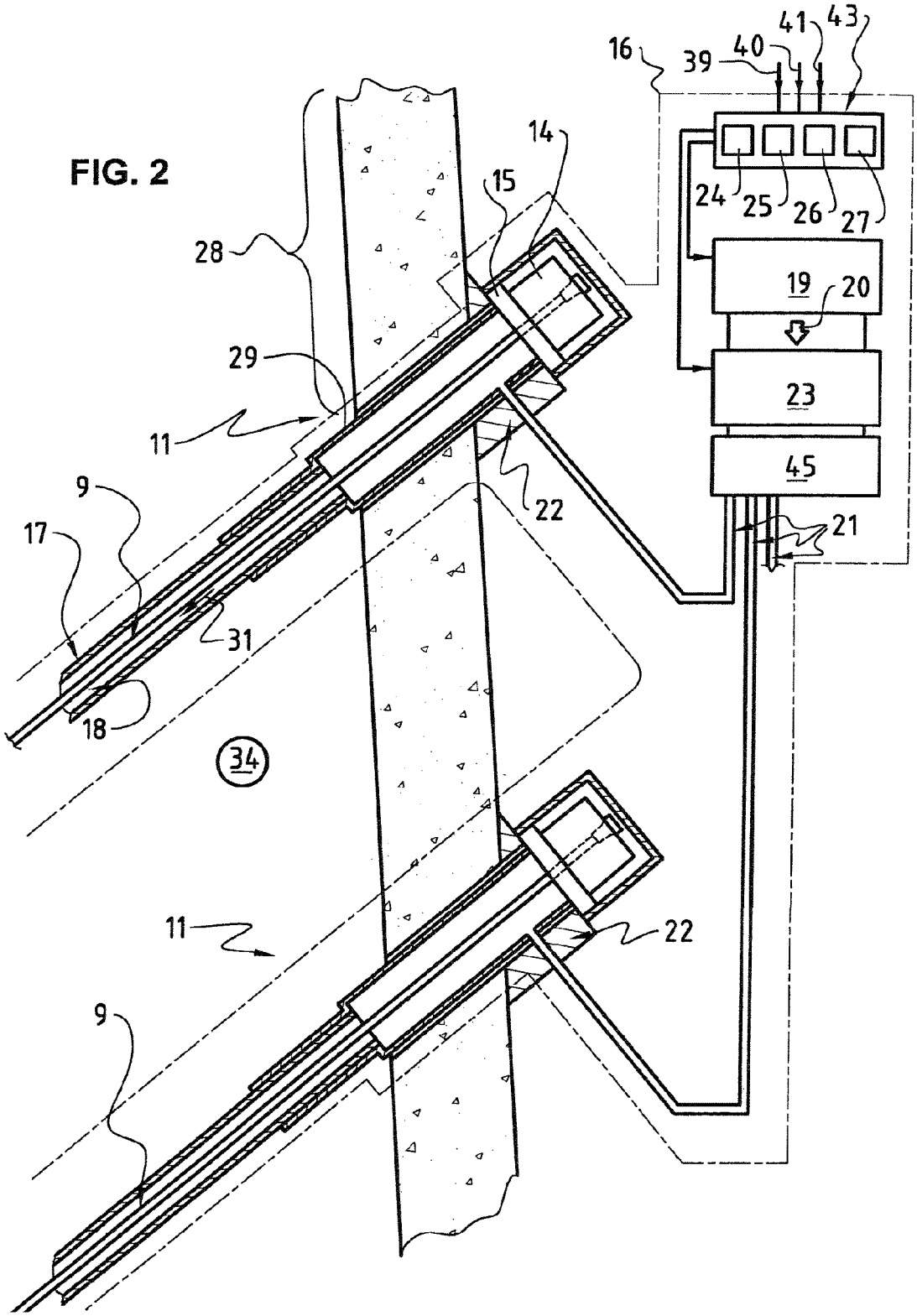
FIG. 2: on an enlarged scale, a partial sectional view of the top of the pylon of the stay cable bridge of FIG. 1.
Figure 3:
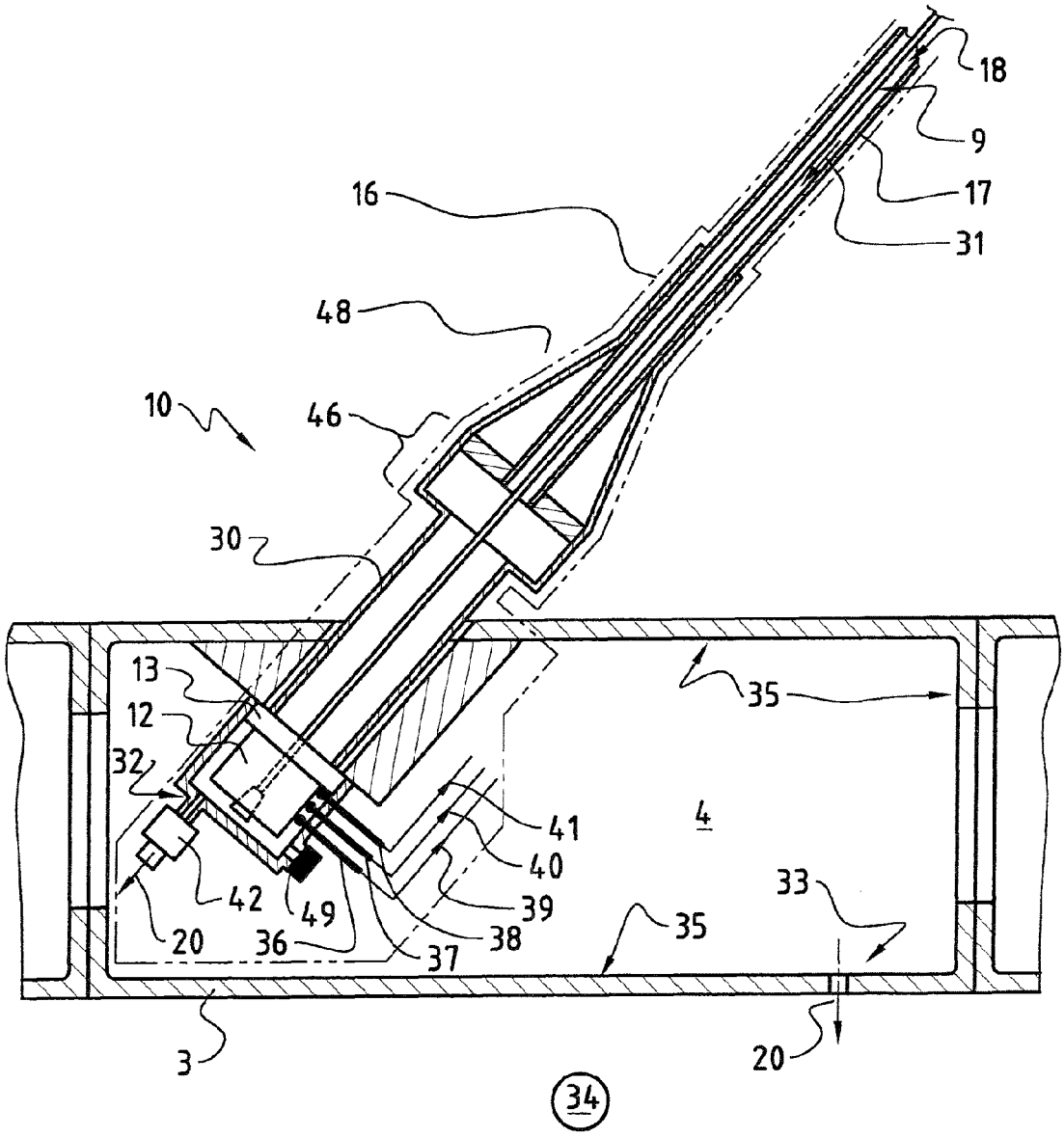
FIG. 3: on an enlarged scale, a partial sectional view of the bottom of the deck anchorage of the stay cable bridge of FIG. 1.

Referring to the drawings, a stay cable construction 1 can be seen. This stay cable construction 1 includes a multiplicity of tension members 8, each tension member 8 being made up of parallel steel tensile elements 9, extending between a first anchorage 10 and a second anchorage 11, comprising two opposite ends, said first end 100 and second end 110, said first end 100 co-operating with the first anchorage 10, and said second end 110 co-operating with the second anchorage 11.

For simplification of the drawings, only one of the aforementioned parallel steel tensile elements 9 has been shown.

According to the invention, the corrosion protection system 16 involves the use of tensile elements 9 which are not provided with a permanent corrosion protection during their fabrication (for example, which are not greased and sheathed in a conventional way), referred to as unprotected tensile elements 9, and this corrosion protection system 16 includes:

a plurality of stay pipes 17, each stay pipe freely surrounding a tension member 8 made up of unprotected tensile elements, a dehumidification device 19 which produces air with a predetermined average humidity rate, this air being referred to as dry air 20, a plurality of pipes, referred to as dry air supply pipes 21, intended to supply the dry air 20 from the dehumidification device 19 to predetermined points 22, each of these points being situated on one of the three devices that are the first anchorage 10, the second anchorage 11, the plurality of stay pipes 17, a ventilation device 23 which pushes the dry air 20 in the pipes of the plurality of dry air supply pipes 21, surveying, measuring, controlling and testing facilities 24 to 27 (surveying (24), measuring (25), controlling (26) and testing (27) facilities).

Sometimes the stay cable construction 1 includes at least one first structural part 2, at least one second structural part 5, said first structural part 2 and said second structural part 5 being connected by a plurality of tension members 8, each extending between a first anchorage 10 situated on the first structural part 2 and a second anchorage 11 situated on the second structural part 5, at least one of said first structural part 2 and said second structural part 5 comprising at least one internal chamber 4.

In a notable manner, each tension member 8 includes tensile elements 9 which are not transversally connected together in such a manner so as to form a group, and are surrounded along their length by air contained in the stay pipe 17.

In a notable manner, the stay pipe 17 is free to move transversally or longitudinally in relation to the tension member 8 which is surrounded.

According to the invention:

the plurality of pipes, referred to as dry air supply pipes 21, are intended to supply the dry air 20 from the dehumidification device 19 to predetermined points 22, which are each situated near one of the devices which are the first anchorage 10 and the second anchorage 11 of each tension member 8, and at least one of the tension members 8 is connected to the first structural part 2 and the second structural part 5 to conduct dry air in the internal chamber 4.

When said stay cable construction 1 is a stay cable bridge, this stay cable bridge includes a first structural part 2 including a deck, at least a second structural part 5 including in a pylon, said second structural part 5 having at least one substantially upright element, which namely includes a first portion 6, which extends under the first structural part 2, and a second portion 7, which extends above the first structural part 2.

For example the first structural part 2 includes a deck which includes a structural member 3 with at least one internal chamber 4.

Also for example, the structural member 3 is made of metal but should be made of metal or concrete or any suitable material.

In a known manner:

each first anchorage 10 includes a first anchorage block 12 supported by a first bearing plate 13, which is borne by the first structural part 2, and each second anchorage 11 includes a second anchorage block 14 supported by a second bearing plate 15, which is borne by a second structural part 5.

In this case, the plurality of pipes, referred to as dry air supply pipes 21, are intended to supply the dry air 20 from the dehumidification device 19 to predetermined points 22, which are each situated near each second anchorage 11 of a tension member 8.

Preferably, the second anchorage 11 and the first anchorage 10 of each tension member 8 are each situated in an enclosure respectively called second anchorage guide 29 and first anchorage guide 30.

In this way, the tensile elements and their anchorages are enclosed within an enclosure all along the length of the stay cable.

For example, the dehumidification device 19 and the ventilation device 23 are situated at the top level 28 of the respective at least one second structural part 5.

In a noteworthy way:

each second anchorage guide 29 is connected, on the one hand, to a dry air supply pipe 21 and, on the other hand, to the stay pipe 17 which surrounds the connected tension member 8, these connections being achieved in such a manner that the air injected in the second anchorage guide 29 can form a dry airflow 31 along the tension member 8 in the stay pipe 17, each first anchorage guide 30 is connected to a stay pipe 17 which surrounds the tension member 8 with which it is connected, and this first anchorage guide 30 includes a dry air outlet, said first dry air outlet 32, through which dry air 20 can escape.

In a noteworthy way:

the first dry air outlets 32 of a plurality of first anchorage guides 30 are connected to at least one internal chamber 4 so as to allow the passage of the dry air 20 which escapes from each of these first dry air outlets 32 to said internal chamber 4, the first structural part 2 includes at least one outlet, said second dry air outlet 33, through which the dry air 20 can escape.

Preferably, the dry air 20 can escape through the second dry air outlet 33, and is exhausted into the outer atmosphere 34 of the stay cable construction 1.

Therefore, the tensile elements 9 and the anchorages of these tensile elements 9 are temporarily corrosion-protected, that is to say they are protected for storage or transport.

Thus, the surfaces that each internal chamber 4 includes are exposed to the dry air 20, and are thereby also corrosion-protected.

These technical features are particularly advantageous because no other corrosion protection system is necessary in order to protect the surfaces of internal chambers of a stay cable construction such as internal chambers of the deck of a stay cable bridge.

According to the invention, the ventilation device 23, which pushes the dry air 20 in the dry air supply pipes 21, provides a predetermined and continuous pressure of dry air 20 along each tension member 8 length to prevent any infiltration of water molecules from the outside environment into the stay pipe 17, the second anchorage guide 29, and the first anchorage guide 30 of each tension element.

In a preferred embodiment:

at least one of the first anchorage guides 30 is equipped with a first sensor 36, a second sensor 37 and a third sensor 38, and these sensors 36 to 38 are intended to measure respectively the rate of humidity, the temperature and the pressure of the dry air 20 in each equipped first anchorage guide 30, to produce respectively a first signal 39, second signal 40 and third signal 41 which correspond to the measured levels of humidity, temperature, and pressure, the first dry air outlets 32 of said plurality of first anchorage guides 30 are each equipped with an airflow control valve, referred to as first automatic airflow control valve 42, this first automatic airflow control valve 42 being adjusted to open when the level of pressure of the air contained in the equipped first anchorage guide 30 rises above a predetermined level of pressure, a pilot unit 43 induces the circulation of dry air 20 in the stay pipes 17 when, according to one of the signals which are the first signal 39, the second signal 40 and the third signal 41 corresponding to the measured levels of humidity, temperature, and pressure, one of the parameters, that are the rate of humidity, the temperature, the pressure, reaches a predetermined value of humidity, temperature, pressure.

The ventilation device 23 and the dehumidification device 19 are preferably placed under the control of the pilot unit 43.

All these technical features allow a continuous monitoring of the corrosion protection system 16.

Furthermore, we note that the continuous circulation of the dry air 20 all along the tension member 8 also equalizes any variation of temperature in said tension member 8.

Preferably, when the stay cable construction 1 includes a predetermined number of distinct groups 44 of tension members 8:

the plurality of dry air supply pipes 21 form a number of groups of dry air supply pipes 21, which is equal to said predetermined number of distinct groups 44 of tension members 8, and each group of dry air supply pipes 21 is connected to the ventilation device by a main pipe, which includes a second airflow control valve 45, each second airflow control valve 45 is of an adjustable type.

The tensile elements 9 can be coated.

For example, the tensile elements 9 are zinc coated, or epoxy coated, or painted.

In a notable manner, the dehumidification device 19 produces dry air 20 from wet air, which is taken from an outer atmosphere 34 of the stay cable construction 1.

In another notable manner, when a tension member 8 includes a damping device 46, said damping device 46 is enclosed inside the enclosure that forms the first anchorage guide 30.

Preferably, each first anchorage guide 30 includes a water drainage pipe 49 connected to a tap (not represented) or closed by a drain-plug (not represented).

The corrosion protection system 16 according to the invention allows a continuous monitoring of the protection.

The corrosion protection system 16 according to the invention gives three levels of protection, which are the continuous dry air 20 around the tensile elements 9, the coating of the tensile elements 9, resulting in the originally planned short durability becoming a long durability, the enclosure achieved all along the cable and defined by the stay pipe 17, the first anchorage guide 29 and the second anchorage guide 30.

The standard operations of maintenance of the corrosion protection system 16 generally comprise replacing filters on dehumidification device 19.

The invention also relates to a stay cable construction 1, corrosion-protected with the afore-described system.

The invention claimed is:

1. A corrosion protection system for a stay cable construction, said stay cable construction including a multiplicity of tension members, each tension member comprising:

parallel steel tensile elements, said tensile elements extending between a first anchorage and a second anchorage and comprising a first end and an opposite second end, the first end co-operating with the first anchorage and the second end co-operating with the second anchorage, the corrosion protection system including tensile elements which are not provided with a permanent corrosion protection during their fabrication, wherein the corrosion protection system further includes:

a plurality of stay pipes, each stay pipe freely surrounding a tension member made up of tensile elements which are not provided with a permanent corrosion protection, a dehumidification device which produces dry air, said dry air having a predetermined average humidity rate, a plurality of dry air supply pipes adapted to supply the dry air from a dehumidification device to predetermined points, each of the predetermined points being situated on one of the first anchorage, the second anchorage, and the plurality of stay pipes, a ventilation device configured to push the dry air in the plurality of dry air supply pipes, and surveying, measuring, controlling and testing facilities wherein the first anchorage of each tension member is situated in a first anchorage guide, and the second anchorage of each tension member is situated in a second anchorage guide and wherein:

each second anchorage guide is connected to a dry air supply pipe and to the stay pipe which surrounds the connected tension member, wherein the connections are achieved in such a manner that the air injected in the second anchorage guide can form a dry airflow along the tension member in the stay pipe, and each first anchorage guide is connected to a stay pipe which surrounds the tension member with which it is connected, and wherein the first anchorage guide includes a first dry air outlet, through which dry air can escape.

2. A corrosion protection system for a stay cable construction according to claim 1, said stay cable construction additionally comprising:

at least one first structural part, and at least one second structural part, wherein the first anchorage is situated on the first structural part and the second anchorage is situated on the second structural part, said first structural part and said second structural part being connected by a plurality of tension members, each tension member extending between the first anchorage situated on the first structural part and the second anchorage situated on the second structural part, at least one of said first structural part and said second structural part comprising at least one internal chamber, the corrosion protection system being characterized in that:

the plurality dry air supply pipes, are configured to supply the dry air from the dehumidification device to predetermined points, which are each situated near one of the first anchorage and the second anchorage of each tension member, and at least one of the tension members is connected to the first structural part and the second structural part to conduct dry air in the internal chamber.

3. A corrosion protection system for a stay cable construction according to claim 2, said stay cable construction additionally comprising a stay cable bridge which includes:

a first structural part including a deck, at least one second structural part including in a pylon, said second structural part having at least one substantially upright element which includes a first portion and a second portion, wherein the first portion extends under the first structural part and the second portion extends above the first structural part.

4. A corrosion protection system according to claim 1, wherein:

each of the first dry air outlets of a plurality of first anchorage guides are connected to at least one internal chamber so as to allow the passage of the dry air which escapes from each of these first dry air outlets to said internal chamber, and wherein the first structural part includes at least one second dry air outlet, through which the dry air can escape.

5. A corrosion protection system according to claim 1, wherein the ventilation device provides a predetermined and continuous pressure of dry air along each tension member length to prevent any infiltration of water molecules from the outside environment into the stay pipe, the second anchorage guide, and the first anchorage guide of each tension element.

6. A corrosion protection system according to claim 1, wherein at least one of the first anchorage guides is equipped with a first sensor, a second sensor and a third sensor, and these sensors are adapted to measure respectively the rate of humidity, the temperature, and the pressure of the dry air in each equipped first anchorage guide, and to produce a first signal corresponding to a measured level of humidity, a second signal corresponding to a measured level of temperature and a third signal corresponding to a measured level of pressure, wherein the first dry air outlets of said plurality of first anchorage guides are each equipped with a first automatic airflow control valve, this first automatic airflow control valve being adjusted to open when the level of pressure of the air contained in the equipped first anchorage guide, rises above a predetermined level of pressure, and wherein a pilot unit induces the circulation of dry air in the stay pipes when, according to one of the first signal, the second signal and the third signal, one of the rate of humidity, the temperature, or the pressure, reaches a predetermined value.

7. A corrosion protection system according to claim 2, wherein, the stay cable construction includes a predetermined number of distinct groups of tension members and:

the plurality of dry air supply pipes form a number of groups of dry air supply pipes, which is equal to said predetermined number of distinct groups of tension members, and each group of dry air supply pipes is connected to the ventilation device by a main pipe, which includes a second airflow control valve, and each second airflow control valve is of an adjustable type.

8. A corrosion protection system according to claim 2, wherein the dehumidification device produces dry air from wet air, which is taken from an outer atmosphere of the stay cable construction.

9. A corrosion protection system according to claim 2, wherein a tension member includes a damping device, said damping device being enclosed inside the enclosure that forms the first anchorage guide.

10. A corrosion protection system according to claim 1, wherein each tension member includes tensile elements which are not transversally connected together in such a manner so as to form a group, and are surrounded along their length by air contained in the stay pipe.

11. A stay cable construction, comprising the corrosion protection system of claim 1.

12. A corrosion protection system for a stay cable construction according to claim 3, wherein the second anchorage of each tension member is situated in a second anchorage guide and the first anchorage of each tension member is situated in a first anchorage guide.

13. A corrosion protection system according to claim 12, wherein:

each second anchorage guide is connected to a dry air supply pipe and to the stay pipe which surrounds the connected tension member, these connections being achieved in such a manner that the air injected in the second anchorage guide can form a dry airflow along the tension member in the stay pipe, and each first anchorage guide is connected to a stay pipe which surrounds the tension member with which it is connected, and the first anchorage guide includes a first dry air outlet, through which dry air can escape.

14. A corrosion protection system according to claim 13, wherein:

the first dry air outlets of a plurality of first anchorage guides are connected to at least one internal chamber so as to allow the passage of the dry air which escapes from each of these first dry air outlets to said internal chamber, the first structural part includes at least one second dry air outlet, through which the dry air can escape.

15. A corrosion protection system according to claim 14, wherein the ventilation device provides a predetermined and continuous pressure of dry air along each tension member length to prevent any infiltration of water molecules from the outside environment into the stay pipe, the second anchorage guide, and the first anchorage guide of each tension element.

16. A corrosion protection system according to claim 15, wherein at least one of the first anchorage guides is equipped with a first sensor, a second sensor and a third sensor, wherein the first sensor is adapted to measure the rate of humidity of the dry air in the at least one first anchorage guide and to produce a first signal corresponding to the measured level of humidity, and the second sensor is adapted to measure the temperature of the dry air in the at least one first anchorage guide and to produce a second signal corresponding to the measured temperature, and the third sensor is adapted to measure the pressure of the dry air in the at least one first anchorage guide and to produce a third signal corresponding to the measured pressure, and wherein the first dry air outlets of said plurality of first anchorage guides are each equipped with a first automatic airflow control valve, this first automatic airflow control valve being adjusted to open when the level of pressure of the air contained in the equipped first anchorage guide rises above a predetermined level of pressure, and wherein a pilot unit induces the circulation of dry air in the stay pipes when, according to one of the first signal, the second signal and the third signal reaches a predetermined value.

17. A corrosion protection system according to claim 16, wherein the stay cable construction includes a predetermined number of distinct groups of tension members and wherein:

the plurality of dry air supply pipes form a number of groups of dry air supply pipes, which is equal to said predetermined number of distinct groups of tension members, and each group of dry air supply pipes is connected to the ventilation device by a main pipe, which includes a second airflow control valve, and each second airflow control valve is of an adjustable type.

18. A corrosion protection system according to claim 6, wherein the stay cable construction includes a predetermined number of distinct groups of tension members and wherein:

the plurality of dry air supply pipes form a number of groups of dry air supply pipes, which is equal to said predetermined number of distinct groups of tension members, and each group of dry air supply pipes is connected to the ventilation device by a main pipe, which includes a second airflow control valve, each second airflow control valve is of an adjustable type.

19. A corrosion protection system for a stay cable construction, said stay cable construction including a multiplicity of tension members, each tension member comprising:

parallel steel tensile elements, said tensile elements extending between a first anchorage and a second anchorage and comprising a first end and an opposite second end, the first end co-operating with the first anchorage and the second end co-operating with the second anchorage, the corrosion protection system including tensile elements which are not provided with a permanent corrosion protection during their fabrication, wherein the corrosion protection system further includes:

a plurality of stay pipes, each stay pipe freely surrounding a tension member made up of tensile elements which are not provided with a permanent corrosion protection, a dehumidification device which produces dry air, said dry air having a predetermined average humidity rate, a plurality of dry air supply pipes adapted to supply the dry air from a dehumidification device to predetermined points, each of the predetermined points being situated on one of the first anchorage, the second anchorage, and the plurality of stay pipes, a ventilation device configured to push the dry air in the plurality of dry air supply pipes, and surveying, measuring, controlling and testing facilities said stay cable construction additionally comprising:

at least one first structural part, and at least one second structural part, wherein the first anchorage is situated on the first structural part and the second anchorage is situated on the second structural part, said first structural part and said second structural part being connected by a plurality of tension members, each tension member extending between the first anchorage situated on the first structural part and the second anchorage situated on the second structural part, at least one of said first structural part and said second structural part comprising at least one internal chamber, the corrosion protection system being characterized in that:

the plurality dry air supply pipes, are configured to supply the dry air from the dehumidification device to predetermined points, which are each situated near one of the first anchorage and the second anchorage of each tension member, and at least one of the tension members is connected to the first structural part and the second structural part to conduct dry air in the internal chamber, wherein the dehumidification device produces dry air from wet air, which is taken from an outer atmosphere of the stay cable construction.

20. A corrosion protection system according to claim 19, wherein a tension member includes a damping device, said damping device being enclosed inside the enclosure that forms the first anchorage guide.

* * * * *